United States Patent [19]

McCoy et al.

[11] 4,221,036

[45] Sep. 9, 1980

[54] METHOD OF SECURING A MOINEAU PUMP STATOR

[75] Inventors: Darl M. McCoy, Horse Shoe, N.C.; Charles W. Hawk, Jr., Cleveland, Tenn.

[73] Assignee: Olin Corporation, New Haven, Conn.

[21] Appl. No.: 856

[22] Filed: Jan. 4, 1979

Related U.S. Application Data

[63] Continuation-in-part of Ser. No. 809,962, Jun. 27, 1977, abandoned.

[51] Int. Cl.[3] ..... B23P 15/00; F01C 5/06

[52] U.S. Cl. ..... 29/156.4 WL; 29/432; 29/526 R; 418/48

[58] Field of Search ..... 29/156.4 R, 156.4 WL, 29/526 R, 526 A, 432; 418/152, 153, 48; 138/147

[56] References Cited

U.S. PATENT DOCUMENTS

| | | | |
|---|---|---|---|
| Re. 16,599 | 4/1927 | Mattice | 29/402 |
| 218,340 | 8/1879 | Toope | 138/147 |
| 1,407,202 | 2/1922 | Kübler | 29/526 |
| 1,745,542 | 2/1930 | Johnson | 29/432 |
| 2,216,784 | 10/1940 | Payne | 29/526 |
| 2,290,137 | 7/1942 | Aldridge | 418/48 |
| 2,879,920 | 3/1959 | Davies | 418/48 |
| 3,479,960 | 11/1969 | Cardoso | 418/48 |
| 3,526,947 | 9/1970 | Pasek | 29/701 |
| 3,733,696 | 5/1973 | Scofield et al. | 29/432 |
| 4,029,443 | 6/1977 | Burnside et al. | 418/48 |

FOREIGN PATENT DOCUMENTS

| | | | |
|---|---|---|---|
| 245279 | 4/1912 | Fed. Rep. of Germany | 138/147 |
| 376091 | 12/1920 | Fed. Rep. of Germany | 138/147 |

*Primary Examiner*—Daniel C. Crane

*Attorney, Agent, or Firm*—Bruce E. Burdick; Thomas P. O'Day

[57] ABSTRACT

A method of assembling progressing cavity pump of the Moineau type having a helically externally threaded rotor coacting with an internally helically threaded stator. In a Moineau pump where the pump casing is a singular tubular unit, the stator is normally bonded to the inside of a tubular housing with an adhesive. When such pumps are used to pump a corrosive fluid, such as caustic soda, the adhesive can be attached and the stator thus freed to rotate. To prevent the stator from rotating, studs are driven through the housing and into the stator. The location of these studs can be pre-marked by use of a suitable template. Also, the driven studs can be welded to the housing to prevent leakage or loosening.

5 Claims, 4 Drawing Figures

METHOD OF SECURING A MOINEAU PUMP STATOR

This is a continuation-in-part of parent application Ser. No. 809,962 filed June 27, 1977, now abandoned.

This invention relates to progressing cavity type pump construction. It relates particularly to improvements in assembling Moineau-type pumps having a helically externally threaded rotor coacting with an internally helically threaded stator.

Pumps of the type generally known as Moineau or Moyno are available commercially and are built with a single-threaded metallic rotor which is rigid and a double-threaded helical stator which is of a flexible material such as rubber. The stator is customarily attached to a tubular casing by means of an adhesive.

The pumps are particularly used by assignee, Olin Corporation, to pump highly abrasive fluids or corrosive fluids such as caustic soda. When used with caustic soda, the adhesive bonding the stator to the casing can be chemically attached by the caustic soda and the stator freed to rotate. Such rotation physically damaged the stator and replacement is soon required.

One method of preventing the stator from rotating is described in U.S. Pat. No. 2,796,029, issued June 18, 1957 to Bourke. In this patent, the pump casing is in two sections with the upper part being bolted to the lower part. The stator is molded to provide lateral extensions. The extensions are clamped in position when the two sections of the casing are bolted together. Molding of the stator to provide lateral extensions requires an additional operation and increases the cost of producing the pump.

In addition, this method is not applicable where the pump casing is a singular, tubular unit with the stator adhesively bonded to the casing. An improved method is thus required for preventing the stator from rotating.

An alternative approach described in U.S. Pat. No. 4,029,443 issued to C. C. Burnside and J. C. Wright on June 14, 1977 and assigned to Olin Corporation has been to provide the tubular housing with internal ridges or ribs and to place conforming grooves on the exterior of the stator so as to key the stator to the housing. However, a simpler and less expensive alternative is needed, preferably one that can eliminate the need for cutting grooves or special ribs.

U.S. Pat. No. 3,479,960 issued Nov. 25, 1960 to Cardoso shows a Moineau stator secured by one or two set screws. Use of set screws requires many steps in the assembly of the stator and housing, namely, selecting a drill bit of proper size, attaching the drill bit to a drill, positioning the drill bit at the proper location on the pump housing, drilling a hole of correct size through the pump housing, choosing a thread tap of proper structure, replacing the drill bit by the thread tap, tapping the drill hole to produce properly aligned threads of proper size, inserting and aligning the set screw in the threaded hole, positioning a screwdriver or allen wrench or tightening device in proper position in the set screw and laboriously rotating the set screw to the proper depth in the threaded hole without being able to see the inside end of the hole or set screw. If there is more than one set screw, all these operations must be repeated for each such set screw. In addition, the Cardoso patent apparently envisions recesses in the stator or lining and alignment of those recesses with the threaded holes in the pump housing so that the stator is not buckled or distorted by the set screws. Additionally, there is doubt that the set screws will seal themselves very well so leaks at the set screws can be expected if the stator becomes porous or even slightly separated from the housing. There is a need for a less laborious and less burdensome assembly method than that described by the Cardoso patent.

It is therefore an object of the present invention to provide an improved method of retaining the stator in a fixed position.

It is a further object of the present invention to provide an improved progressive cavity pump suitable for use with corrosive fluids.

An additional object of the present invention is to provide a method for quickly modifying conventional Moineau pumps to allow corrosive service.

These and other objects of this invention are accomplished in a method of securing a resilient, internally helically ribbed, tubular Moineau-type pump stator within a rigid surrounding tubular housing to prevent rotation or axial movement of said stator within said housing when a Moineau-type pump rotor rotates therewithin, which method comprises the steps of driving a plurality of studs through said rigid housing and partially into said resilient stator.

The method of the present invention can be used to produce the apparatus illustrated in the accompanying FIGS. 1-4. Corresponding parts have the same numbers in all Figures.

Figure 1:
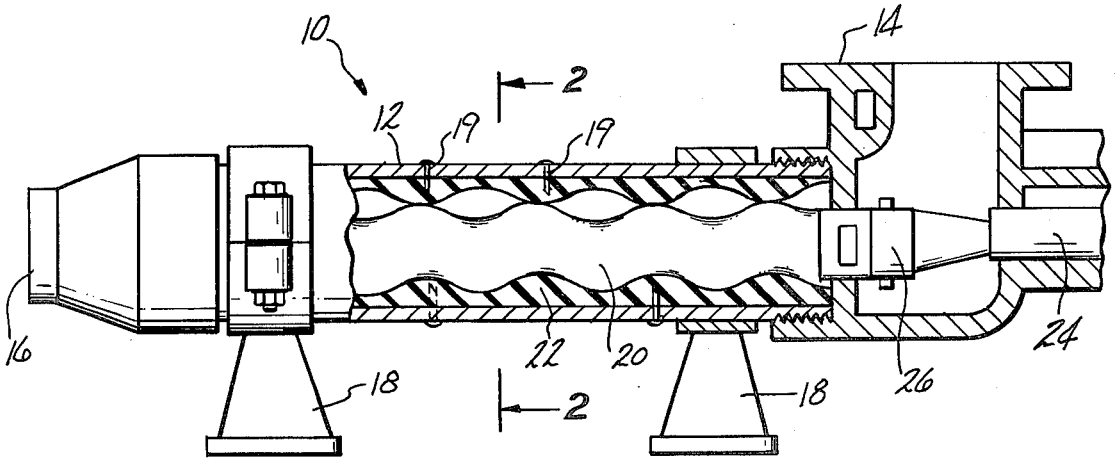
FIG. 1 illustrates an elevational view partially sectioned of a typical moineau pump having a stator secured by use of the present invention.

Referring to FIG. 1, pump 10 has a housing 12, inlet 14, outlet 16, mounting brackets 18 and studs 19. The pumping mechanism comprises a rotor 20 which is generally a rigid material and a stator 22 which is a flexible material such as rubber. Rotor 20 operates within stator 22.

Rotor 20 is connected to drive shaft 24 by means of a universal joint generally indicated as 26. Housing 12 can be provided with at least one antirotation rib running lengthwise along the inner wall of casing 12 and curbs 30 can also be provided to help prevent axial movement of stator 22 within housing 12. Both ribs 28 and 30 are described in aforementioned U.S. Pat. No. 4,029,443 to Burnside et al which is incorporated by reference as if set forth at length herein.

Studs 19 are provided during assembly as hereafter noted to prevent rotation of stator 22 within a rigid housing 12.

The principles of the progressing cavity pump are well known and will not be further described.

While using the improved pump of the present invention, for example, with corrosive liquids such as caustic soda, the stator is prevented from rotating by the inner ends of studs 19 which lie in the pump stator 22 and are axially retained within the housing by studs 19, thus helping avoid damage to the stator.

The studs 19 can be inserted in quick and simple manner by use of tubular template 32 having a plurality of radial holes 34 of any suitable size. Any other template having suitable openings could equivalently be used. The preferred method is to align housing 12, with stator 22 already adhesively secured, within template 32 so that the holes 34 are located radially about the thicker portions 23 of stator 22 rather than at the thinner portions 25 thereof.

With the template thus placed, paint or other marking medium (not shown) is passed through holes 34 to mark the desired locations for studs 19. Template 32 can then be removed and studs 19 driven through housing 12 and into stator 22 at said marked positions on housing 12 utilizing a commercially available stud driving gun (not shown).

Figure 2:
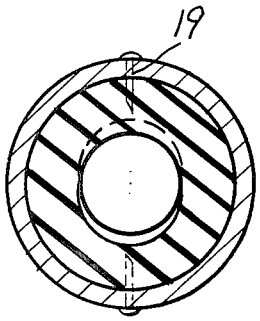
FIG. 2 shows an enlarged cross-sectional view taken along line 2—2 of FIG. 1, the outlet and brackets being deleted for clarity.
Figure 3:
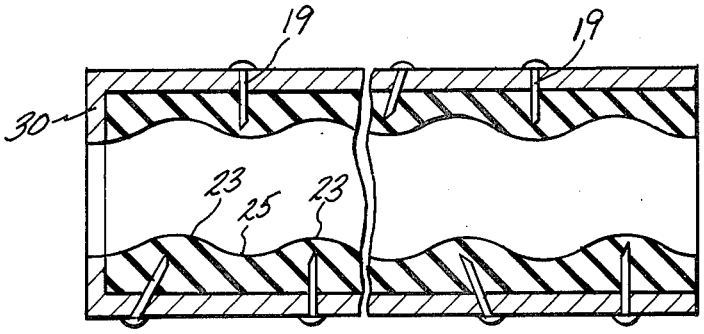
FIG. 3 shows a cross-section of the pump casing with the improvement of the present invention.
Figure 4:
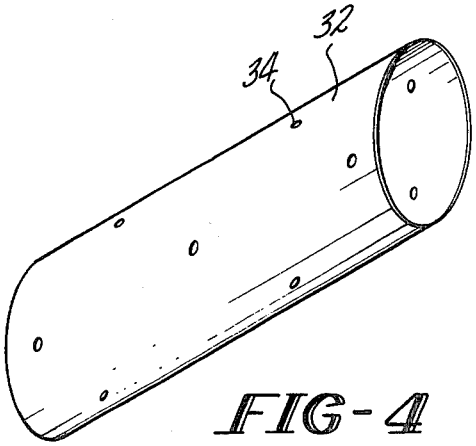
FIG. 4 is a perspective view of a template usable in the method of the present invention.

Studs 19, as shown in FIGS. 1, 2 and 3 of this application and FIGS. 1, 2 and 3 of parent application Ser. No. 809,962, are pin-type unthreaded studs which are driven linearly through housing 12 and into stator 22. For example, eight three-quarter inch long Fix-Rammer brand studs have proven sufficient and suitable for securing stators of Moineau pumps used for pumping mercury-sodium amalgam where breakdown of conventional adhesives between stator and housing had been a problem. As noted above, any commercially available "stud driving gun" refers to an extremely rapid-acting linear drive device which "shoots" an unthreaded stud linearly into or through an object such as housing 12 in a fashion similar to the manner in which the normal "gun" i.e. rifle or pistol, shoots a bullet into or through an object. Thus each pin-type stud 19 simultaneously creates and fills a hole through housing 12. A plurality of such studs 19 are used to secure stator 22. While two or three studs are believed to be sufficient, eight or more are preferred to minimize the force on each stud for extra safety.

To prevent leakage between studs 19 and housing 12 from the interior of housing 12 to the exterior of housing 12, the outer ends of studs 19 can be welded to the housing 12. This welding also serves to prevent studs 19 from being backed out of stator 22 by the pumping operation of pump 10. Preferably studs 19 will be driven in before the housing 12 is placed within brackets 18 or attached to outlet 16 or inlet 14, so that a simple tubular template 32 can easily and quickly slide over housing 12 and rapidly align therewith. Following such insertion of studs 19, the pump can be fully assembled and operation thereof begun in otherwise conventional manner.

It is understood that the drawings illustrate only one exemplary preferred device employing the method of this invention and that Applicants intend this invention to be usable on many other similar structures.

I claim:

1. A method of securing a resilient, internally helically ribbed, tubular Moineau-type pump stator within a rigid surrounding tubular housing to prevent rotation or axial movement of said stator within said housing when a Moineau-type pump rotor rotates therewithin, which method comprises the steps of linearly providing a tubular housing having a resilient Moineau-type pump stator mounted therein and driving with a gun a plurality of unthreaded pin-type studs through said rigid housing and partially into said resilient stator so as to simultaneously create and fill a hole through said rigid housing.

2. The method of claim 1 further comprising welding said driven studs to said housing so as to prevent said studs from backing out of said stator and to prevent leakage between said studs and said housing.

3. The method of claim 2 wherein said pump stator has an inlet and outlet, and a plurality of said studs are driven at an angle into said stator such that the inner ends of said plurality are closer to the longitudinal center of said stator than the outer ends of said studs.

4. The method of claim 1, which further comprises:

(a) surrounding said tubular housing with a tubular template having radial guide holes placed therein in locations conforming to desired locations of said studs;

(b) moving said template about said housing so as to align said guide holes with predetermined positions on said tubular housing;

(c) marking said housing through said template to identify said predetermined positions;

(d) removing said template from said housing, and (e) said studs being thereafter driven through said housing at said predetermined locations.

5. The method of claim 4, further comprising welding said driven studs to said housing so as to prevent said studs from backing out of said stator and to prevent leakage between said studs and said housing.

* * * * *

UNITED STATES PATENT AND TRADEMARK OFFICE

CERTIFICATE OF CORRECTION

PATENT NO. : 4,221,036

DATED : September 9, 1980

INVENTOR(S) : Darl M. McCoy
Charles W. Hawk

It is certified that error appears in the above-identified patent and that said Letters Patent are hereby corrected as shown below:

Column 4, line 13, Claim 1, delete "linearly".

Column 4, line 15, Claim 1, after "and", insert --linearly--.

Signed and Sealed this

*Third* Day of *March 1981*

[SEAL]

*Attest:*

RENE D. TEGTMEYER

*Attesting Officer*

*Acting Commissioner of Patents and Trademarks*